US006116377A

United States Patent [19]

Dugan

[11] Patent Number: 6,116,377

[45] Date of Patent: Sep. 12, 2000

[54] SOUND ATTENUATION DEVICES FOR INTERNAL COMBUSTION ENGINES

[76] Inventor: Jimmie Robert Dugan, P.O. Box 149, Midland, Ark. 72945

[21] Appl. No.: 09/222,154

[22] Filed: Dec. 29, 1998

[51] Int. Cl.[7] ..... F01N 1/08

[52] U.S. Cl. ..... 181/272; 276/251

[58] Field of Search ..... 181/249, 250, 181/251, 264, 268, 269, 272, 273, 276, 282

[56] References Cited

U.S. PATENT DOCUMENTS

| | | | |
|---|---|---|---|
| 1,266,255 | 5/1918 | Harris . | |
| 1,900,027 | 3/1933 | Radecky . | |
| 2,131,001 | 9/1938 | Prochnow | 181/272 |
| 3,754,619 | 8/1973 | McCormick . | |
| 4,055,231 | 10/1977 | Martinez . | |
| 4,192,403 | 3/1980 | Nakagawa et al. | 181/272 |
| 4,909,347 | 3/1990 | Wang | 181/272 |
| 5,025,890 | 6/1991 | Hisashige et al. | 181/272 |
| 5,183,976 | 2/1993 | Plemons, Jr. . | |

*Primary Examiner*—Khanh Dang
*Attorney, Agent, or Firm*—Lawrence R. Watson, Esq.; Gardere & Wynne, L.L.P.

[57] ABSTRACT

A sound attenuation device for internal combustion engines includes a tubular core extending from an inlet end to an outlet end and having apertures formed therethrough to allow fluid communication between the interior and the exterior of the tubular core. One or more flanges position the tubular core in an exhaust passageway and are provided with apertures so that exhaust flowing through the exhaust passageway can flow either through the tubular core or through the flange apertures. End caps may be employed to close the inlet end of the tubular core and to provide a reduced diameter opening at the outlet end thereof.

19 Claims, 5 Drawing Sheets

SOUND ATTENUATION DEVICES FOR INTERNAL COMBUSTION ENGINES

TECHNICAL FIELD

This invention relates generally to sound attenuation devices for internal combustion engines, and more particularly to a sound attenuation device which is particularly adapted for use in conjunction with high performance engines such as those employed in automobile racing, boat racing, aircraft racing, off-road applications, industrial applications, and the like.

BACKGROUND AND SUMMARY OF THE INVENTION

Since the dawn of the automotive age, literally thousands of sound attenuation devices, i.e., mufflers, have been designed in controlling the noise that is characteristic of the exhaust of an unregulated internal combustion engine. However, despite the considerable effort that has heretofore been put forward in providing effective sound attenuation for internal combustion engines, still further improvement in the art is needed. This is particularly true in the case of high performance engines intended for use in automobile racing, boat racing, aircraft racing, off-road applications, industrial applications, and the like. This is true because high performance engines often have cam shafts and compression ratios which differ markedly from those of conventional automobile engines, and are often provided with exotic fuels which have operational characteristics which differ markedly from those of conventional gasoline.

The problem in designing a workable sound attenuation device for high performance engines stems from the fact that sound attenuation devices used in conjunction with internal combustion engines perform two functions in connection therewith. As will be apparent, the first function is that of controlling the exhaust noise generated by operation of the engine. The second function involves controlling the back pressure of the exhaust of the engine. Exhaust back pressure control is essential because when the back pressure is too low the engine tends to overheat, leading to burned valves, etc. Conversely, when the back pressure is too high, the performance of the engine is diminished, a condition which cannot be tolerated in high performance engines. Consistency in exhaust back pressure is also important in order that the engine will run reliably.

For example, in high performance race-car engines, it is common to use a different size exhaust tube, or meter tube, connected to each cylinder of the engine in an attempt to maintain the same exhaust back pressure on each cylinder. The present invention allows all of the cylinders to be manifolded into a common passageway which discharges through the present invention and the sound attenuation device of the present invention holds a constant back pressure on all engine cylinders.

The present invention is a sound attenuation device for internal combustion engines which fulfills the foregoing and other requirements long since found lacking in the prior art. In accordance with the broader aspects of the invention, a sound attenuation device comprises a tubular core having a hollow interior extending from an inlet to an outlet. The tubular core has a plurality of relatively small openings formed therein at axially and circumferentially spaced apart locations. One or more flanges extend radially outward from the tubular core and position in the tubular core in the center of an exhaust passageway. Each flange has a plurality of relatively large perforations extending therethrough.

In the operation of the sound attenuation device a portion of the exhaust gases flowing through the exhaust passageway flow through the hollow interior of the tubular core. The remainder of the exhaust gases flow around the exterior of the tubular core through the perforations in the flange(s). The openings in the tubular core allow fluid communication between the interior and exterior thereof. The exhaust gases are recombined at the outlet of the tubular core.

In accordance with a first embodiment of the invention, the hollow interior of the tubular core is unrestricted throughout its length. In accordance with a second embodiment of the invention, the tubular core is provided with end-caps, including an inlet end-cap which is closed and an outlet end-cap which has a relatively small diameter passageway formed therethrough. This construction reduces the percentage of exhaust gases flowing into the interior of the tubular core.

It is an advantage of the present invention to provide a sound attenuation device which equalizes the exhaust back pressure on all cylinders of an internal combustion engine, thereby improving efficiency and increasing performance.

It is an advantage of the present invention to provide a sound attenuation device for internal combustion engines which eliminates the need for an enlargement in diameter in the exhaust passageway, which may be inserted in the existing exhaust pipe of the engine or which may be encased in a housing and connected to the discharge end of the exhaust pipe, and which is approximately ten percent (10%) of the weight of a conventional muffler.

BRIEF DESCRIPTION OF THE DRAWINGS

A more complete understanding of the invention may be had by reference to the following Detailed Description when taken in conjunction with the accompanying Drawings wherein.

DETAILED DESCRIPTION

Figure 1:
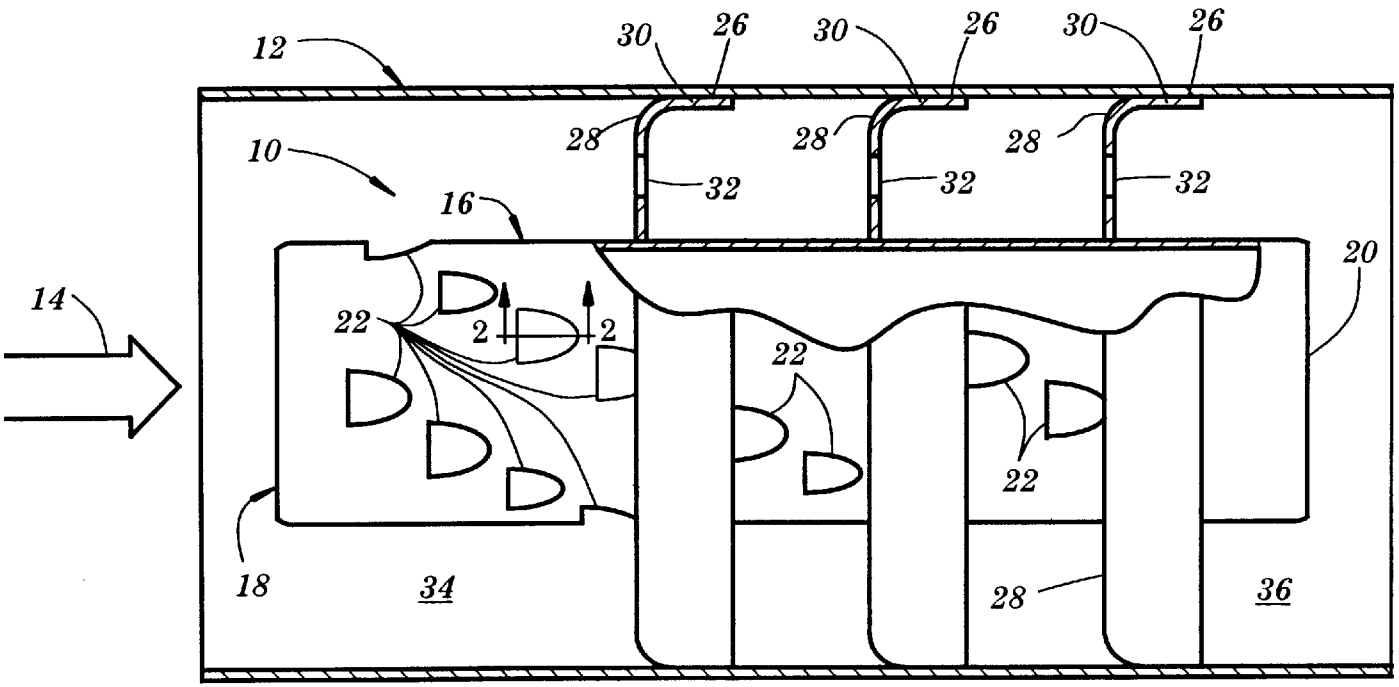
FIG. 1 is an illustration of a sound attenuation device for internal combustion engines comprising a first embodiment of the invention.

Referring now to the Drawings, and particularly to FIG. 1 thereof, there is shown a sound attenuation device 10 comprising a first embodiment of the invention. The sound attenuation device is positioned within an exhaust passageway 12 extending from an internal combustion engine (not shown) wherein exhaust gases flow from the internal combustion engine in the direction of the arrow 14. The exhaust passageway 12 is illustrated as being cylindrical in shape; however, it will be understood that the invention may be utilized in conjunction with exhaust passageways having various cross-sectional configurations depending upon the requirements of particular applications of the invention.

The sound attenuation device 10 includes a tubular core 16 comprising a right circular cylinder. The tubular core 16 is hollow throughout its length and has an inlet end 18 and an outlet 20. The tubular core 10 has a plurality of D-shaped perforations formed therein.

Figure 2:
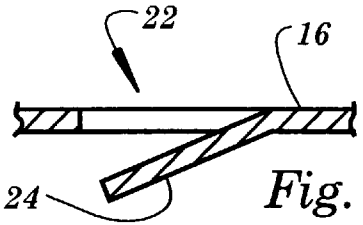
FIG. 2 is a sectional view taken along the lines 2—2 in FIG. 1 in the direction of the arrows.

As is best shown in FIG. 2, the perforations 22 comprise sections 24 of the wall of the tubular core 16 which are deflected inwardly to define the openings 22 which face in the direction of exhaust gas flow as defined by the arrow 14. Thus, the sections 24 define scoops which deflect exhaust gases outwardly. Referring again to FIG. 1, the openings 22 are arranged in a helical pattern. As will be appreciated by those skilled in the art, the shape, size, and pattern of the openings 22 may be varied in accordance with particular applications of the invention.

The sound attenuation device 10 further comprises at least one apertured flange 26. In the embodiment of the invention illustrated in FIG. 1, three flanges 26 are used; however, it will be understood that any number of flanges may be utilized in the practice of the invention depending upon the requirements of particular applications thereof.

Each flange 26 comprises a radially extending portion 28 which is secured to the tubular core 16 and extends outwardly therefrom to the exhaust passageway 12, and an axially extending portion 30 which extends from the distal end of the radially extending portion 28 parallel to and in engagement with the exhaust passageway 12. The flange(s) 26 function to center the tubular core 16 in the exhaust passageway 12. The radially extending portions 28 of the flange(s) 26 have a plurality of passageways 32 formed therethrough. In the embodiment of the invention illustrated in FIG. 1, about 12 passageways 32 are formed in each flange 28 at equally spaced intervals around the circumference of the tubular core 16. It will be understood that the number, size, and spacing of the passageways 32 may be varied in accordance with the requirements of particular applications of the invention.

In the operation of the sound attenuation device 10, exhaust gases flow from an internal combustion engine through the passageway 12 in the direction of the arrow 14. Upon engagement with the sound attenuation device 10, some of the exhaust gases flow directly through the hollow interior of the tubular core thereof. The remainder of the exhaust gases pass around the exterior of the tubular core 16 through the apertures 32 of the flange(s) 28. At each flange 26 there occurs a pressure build-up on the upsteam side and a pressure reduction on the down steam side. The pressure reduction on the down steam side of each flange cooperates with the sections 24 to cause exhaust gases to flow outwardly from the interior of the core 16.

The operation of the sound attenuation device 10 will be further understood by imaging an inlet zone 34 comprising an annulus surrounding the inlet end of the tubular core 16 and an exhaust zone 36 comprising an annulus surrounding the outlet end 20 of the tubular core 16. In the inlet zone 34, exhaust gases flowing through the passageway 12 in the direction of the arrow 14 are divided, with part of the exhaust gases flowing through the hollow interior of the tubular core 16 and the remainder of the exhaust gases of the flange(s) 26. The openings 22 serve as scoops which direct exhaust gases outwardly from the interior of the tubular core 16. This phenonmenum is enhanced by the reduced pressure zone on the down steam side of each flange 26. In the outlet zone 36 the gases flowing through the apertures 32 are recombined with the gases flowing through the hollow interior of the tubular core 16 and continue flowing through the passageway 12 in the direction of the arrow 14.

Figure 3:
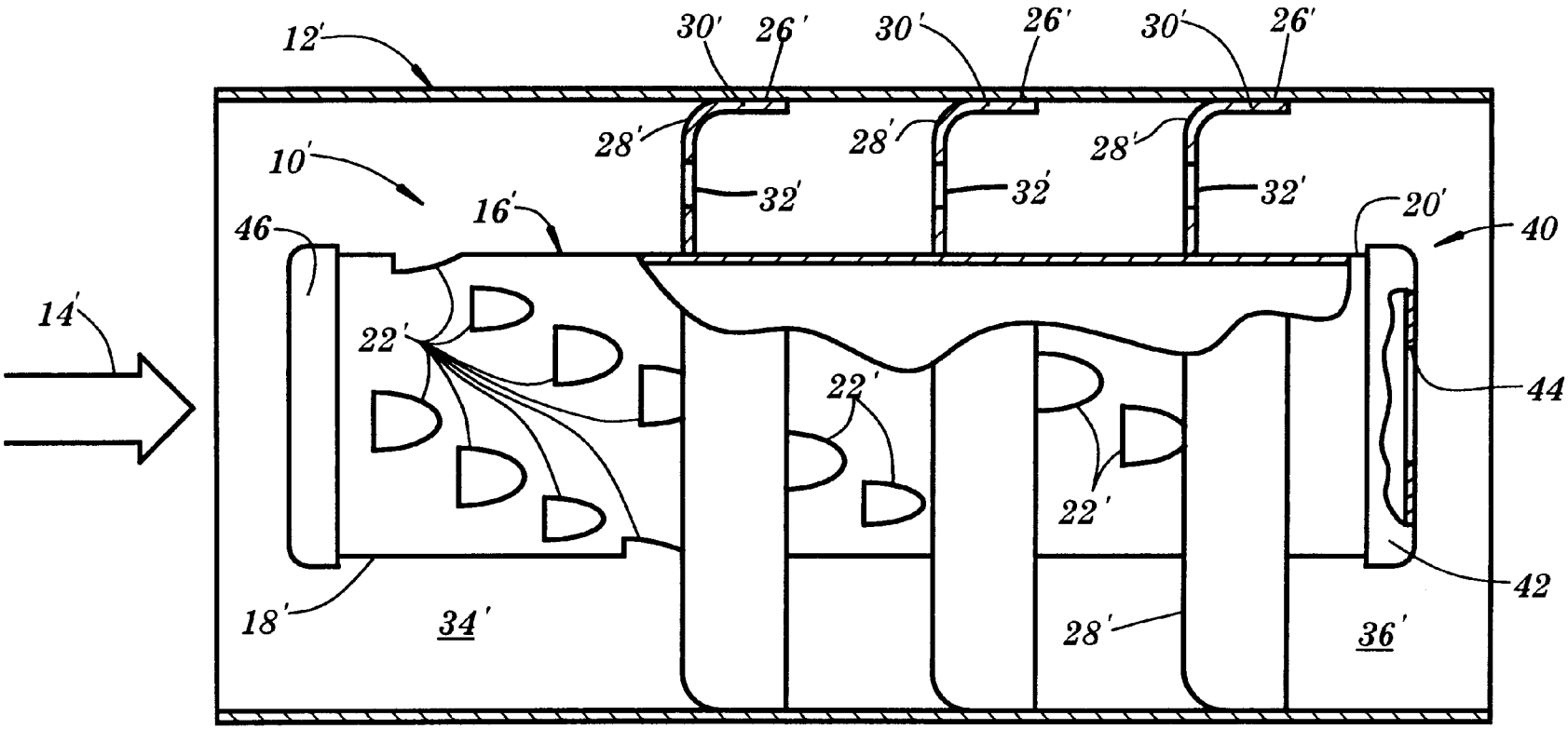
FIG. 3 is an illustration of a sound attenuation device for internal combustion engines comprising a second embodiment of the invention.

Referring now to FIG. 3, there is shown a sound attenuation device 40 comprising a second embodiment of the invention. Many of the component parts of the sound attenuation device 40 are substantially identical in construction and function to component parts of the sound attenuation device 10 shown in FIG. 1 and described hereinabove in conjunction therewith. Such identical component parts of the sound attenuation device 40 are designated with the same reference numerals utilized in the description of the sound attenuation device 10, but are differentiated therefrom by a prime (') designation.

The sound attenuation device 40 differs from the sound attenuation device 10 in that the outlet 20' of the tubular core 16' of the sound attenuation device 40 is provided with an end-cap 42. The end-cap 42 has an aperture 44 formed therein which is characterized by a diameter which is substantially smaller than the inside diameter of the hollow interior of the tubular core 16'. The sound attenuation device 40 is further differentiated from the sound attenuation device 10 in that the inlet end 18' of the tubular core 16' is provided with a fully closed end-cap 46. The presence of the end-cap 46 prevents exhaust gases from flowing inwardly through the inlet 20' of the tubular core 16', thereby forcing exhaust gases passing through the hollow interior of the tubular core 16 to flow outwardly around the end-cap 46 and inwardly through the openings 22' situated in the inlet zone 34'.

In the operation of the sound attenuation device 40 the exhaust gases flowing through the passageway 12' in the direction of the arrow 14' enter the entrance zone 34'. Some of the exhaust gases enter the hollow interior of the tubular core 16' through the openings 22', while the remainder of the exhaust gases flow around the tubular core 16' and through the apertures 32' of the flange(s) 26'. The exhaust gases flowing through the interior of the tubular core 16' are directed outwardly therefrom through the openings 22' and recombine with the exhaust gases flowing through the apertures 32' in the discharge zone 36'. From the discharge zone 36', the exhaust gases continue flowing through the passageway 12' in the direction of the arrow 14'.

Sound attenuation devices constructed in accordance with the present invention may be constructed from mild steel. Conventional metal manufacturing procedures may be employed in the fabrication of the component parts of sound attenuation devices incorporating the invention. For example, a conventional punch press may be employed to perform the blanking, piercing, perforating, and forming operations which are employed in the conventional manner to manufacture the component parts of the sound attenuation device. The flanges of the sound attenuation device may be connected to the tubular core thereof by conventional manufacturing procedures, for example, by welding. Following assembly, the exposed surfaces of the sound attenuation device may be provided with a conventional ceramic coating to prevent corrosion.

Figure 4:
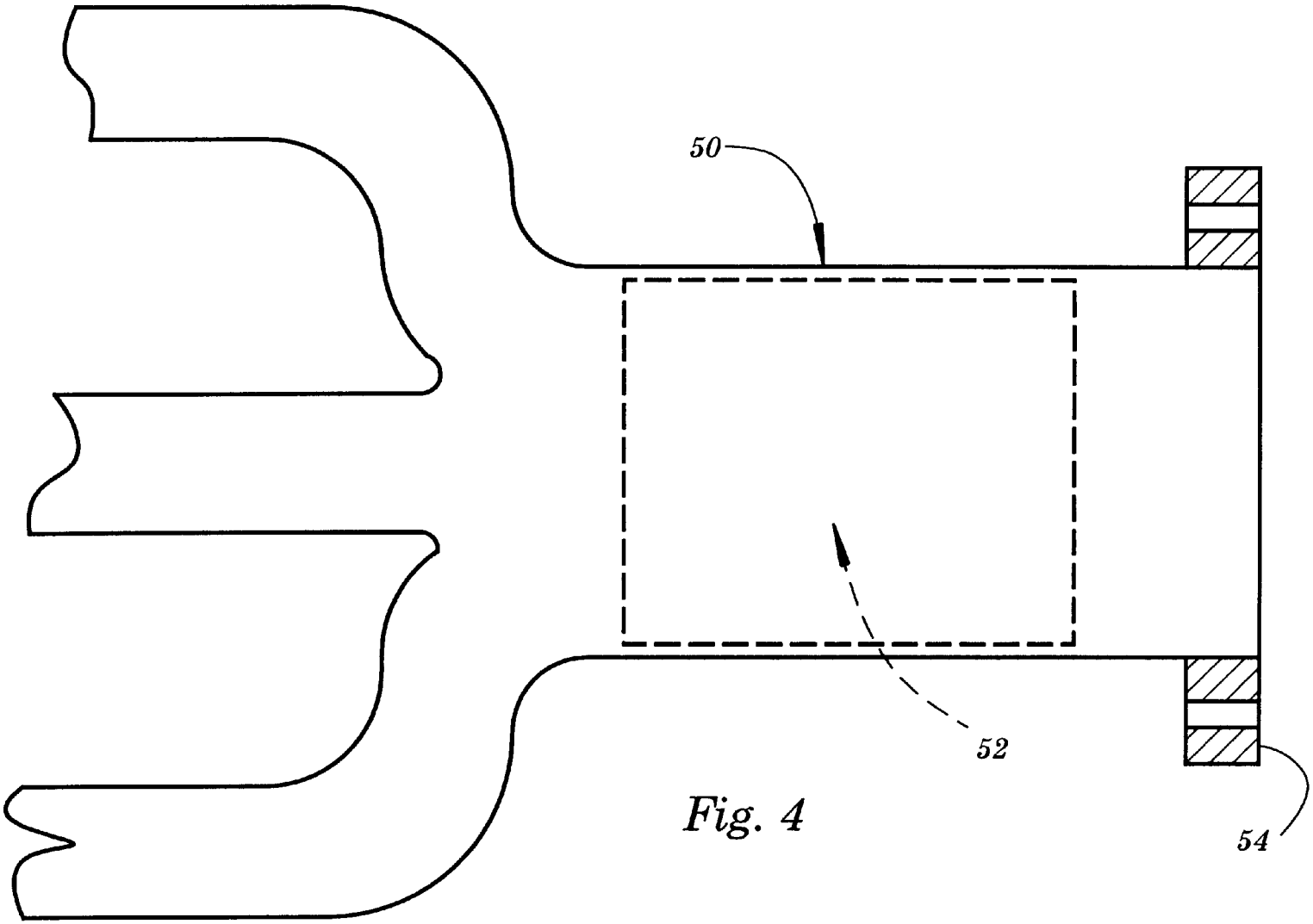
FIG. 4 is an diagrammatical illustration of a first application of the invention.

Referring now to FIGS. 4, 5, 6, and 7, various applications of the sound attenuation device of the present invention are diagrammatically illustrated. Referring particularly to FIG. 4, there is shown a conventional collector 50 comprising part of the exhaust system of an internal combustion engine. A sound attenuation device 52 construed in accordance with the present invention is positioned within the collector 50. The collector 50 may be provided with a flange 54.

Figure 5:
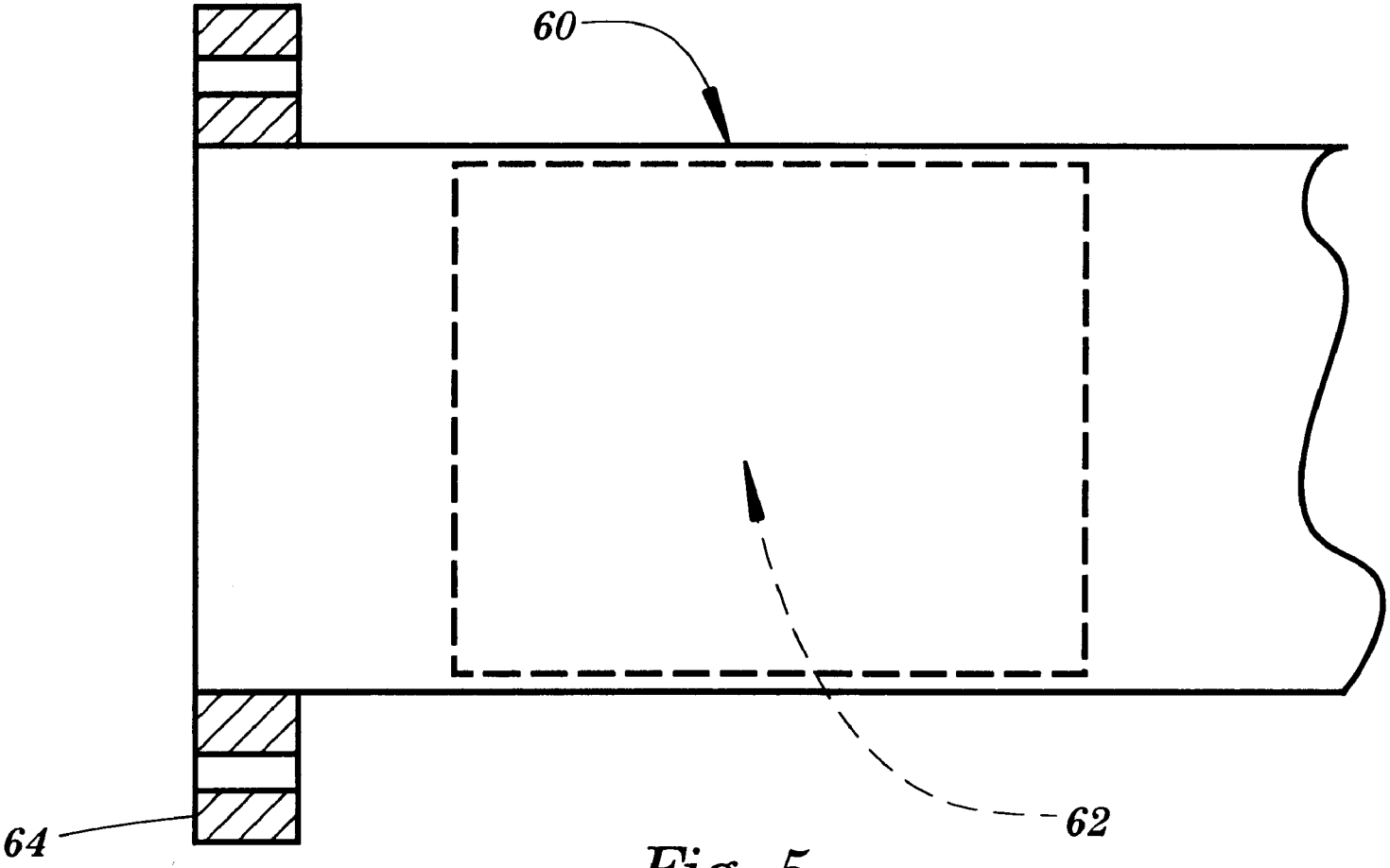
FIG. 5 is a diagrammatical illustration of a second application of the invention.

FIG. 5 illustrates a conventional extension 60 comprising part of the exhaust system of an internal combustion engine. A sound attenuation device 62 constructed in accordance with the present invention is shown mounted in the extension 60. The extension 60 may be provided with a flange 64.

Figure 6:
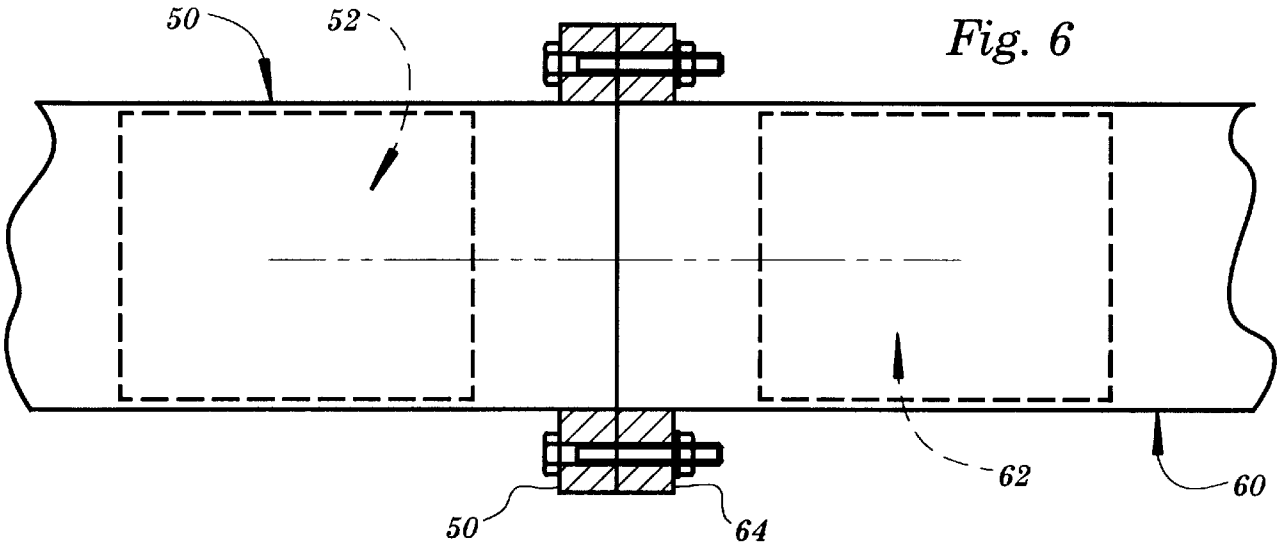
FIG. 6 is a diagrammatical illustration of a third application of the invention.

In FIG. 6, the collector 50 may be connected to the extension 60 utilizing the flanges 54 and 64 in the conventional manner. In such instances the sound attenuation devices 52 and 62 are utilized in tandem. The sound attenuation devices 52 and 62 may be constructed as illustrated in FIG. 1, or as illustrated in FIG. 3, depending on the requirements of particular applications of the invention. Alternatively, one of the sound attenuation devices 52/62 may be constructed as illustrated in FIG. 1 and the other may be constructed as illustrated in FIG. 3.

Figure 7:
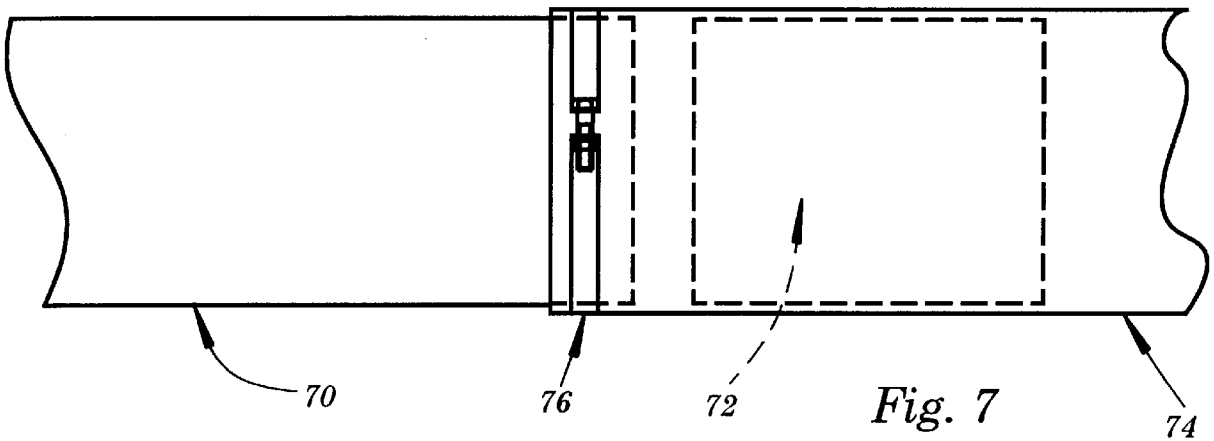
FIG. 7 is a diagrammatical illustration of a fourth application of the invention.

In FIG. 7 there is shown an exhaust pipe 70 comprising part of the exhaust system of an internal combustion engine. A sound attenuation device 72 is mounted in a cannister 74. The cannister 74 is mounted at the distal end of the exhaust pipe 70 by conventional connection apparatus 76. The sound attenuation device 72 may be constructed either as shown in FIG. 1 or as shown in FIG. 3 depending upon the requirements of a particular applications of the invention.

Although preferred embodiments of the invention have been illustrated and the accompanying drawings described in the foregoing detailed description, it will be understood that the invention is not limited to the embodiments disclosed, but is capable of numerous rearrangements, modifications, and substitutions of parts and elements without departing from the spirit of the invention.

I claim:

1. A sound attenuation device for the exhaust passageway of an internal combustion engine, comprising:

a tubular core having an inlet end, an outlet end, and a passageway extending through the inlet and outlet ends; and an apertured flange extending transversely outwardly from the core between the inlet and outlet ends for engaging the exhaust passageway, creating an annulus between the core and the exhaust passageway, and defining an entrance zone surrounding the inlet end of the core and a discharge zone surrounding the outlet end of the core, the flange holding the core so that the inlet end of the core extends away from the flange into the entrance zone without contacting the exhaust passageway and exhaust from the engine is free to flow directly through the apertured flange into the discharge zone and directly through the core passageway into the discharge zone, and so that a portion of the exhaust flows from the entrance zone, through the apertured flange and annulus, and out of the attenuation device without entering the core passageway; and a portion of the exhaust flows from the entrance zone, into the core passageway, and out of the attenuation device without passing through the apertured flange.

2. The sound attenuation device according to claim 1 wherein the exhaust flow through the outlet end of the core passageway into the discharge zone creates an area of reduced pressure in the annulus adjacent the flange and thereby increases the exhaust flow through the flange apertures and the annulus.

3. The sound attenuation device according to claim 1 wherein the tubular core is further characterized by a plurality of apertures extending therethrough to provide fluid communication between the interior and the exterior of the core.

4. The sound attenuation device according to claim 3 wherein the apertures of the tubular core are arranged in a helical pattern.

5. The sound attenuation device according to claim 4 wherein the apertures in the tubular core are in the form of scoops which direct exhaust gases outwardly from the interior of the tubular core into the annulus surrounding the tubular core.

6. The sound attenuation device according to claim 3 further including an end cap mounted on the inlet end of the tubular core.

7. The sound attenuation device according to claim 6 wherein the end cap on the inlet end of the tubular core closes the inlet end of the tubular core and leaves the apertures open.

8. The sound attenuation device according to claim 3 further including an end cap mounted on the outlet end of the tubular core, the end cap at the outlet end of the core having an aperture formed therethrough which is substantially smaller in diameter than the diameter of the tubular core.

9. The sound attenuation device according to claim 8 further including an end cap mounted on the inlet end of the tubular core and closing the inlet end of the tubular core while leaving the apertures open.

10. The sound attenuation device according to claim 1, comprising:

a plurality of apertured flanges extending outwardly from the core between the inlet and outlet ends for engaging the exhaust passageway.

11. A sound attenuation device for use in an exhaust passageway extending from an internal combustion engine comprising:

a tubular core comprising a hollow cylinder extending from an inlet end to an outlet end; and at least one flange secured to the exterior of the tubular core for positioning the tubular core in the exhaust passageway and having a plurality of apertures therethrough so that exhaust gases generated by operation of the internal combustion engine and flowing through the exhaust passageway can flow either through the tubular core or through the apertures of the flange, and so that a portion of the exhaust gases flows through the apertures of the flange and out of the attenuation device without entering the tubular core, and a portion of the exhaust gases flows through the tubular core and out of the attenuation device without passing through the apertures of the flange.

12. The sound attenuation device according to claim 11 wherein the tubular core is further characterized by a plurality of apertures extending through the tubular core to provide fluid communication between the interior and the exterior thereof, the apertures extending through the tubular core being relatively smaller than the apertures extending through the flange.

13. The sound attenuation device according to claim 12 wherein the apertures of the tubular core are arranged in a predetermined pattern lengthwise of the tubular core.

14. The sound attenuation device according to claim 13 wherein the apertures in the tubular core are in the form of scoops which direct exhaust gases outwardly from the interior of the tubular core into the annulus surrounding the tubular core.

15. The sound attenuation device according to claim 13 further including an end cap mounted on the inlet end of the tubular core.

16. The sound attenuation device according to claim 15 wherein the end cap on the inlet end of the tubular core closes the inlet end of the tubular core and leaves the apertures open.

17. The sound attenuation device according to claim 13 further including an end cap mounted on the outlet end of the tubular core, the end cap at the outlet end of the core having an aperture formed therethrough which is substantially smaller in diameter than the diameter of the tubular core.

18. The sound attenuation device according to claim 17 further including an end cap mounted on the inlet end of the tubular core and closing the inlet end of the tubular core while leaving the apertures open.

19. The sound attenuation device according to claim 11 wherein the apertures of the flange are positioned at substantially equally spaced locations around the periphery of the tubular passageway.

* * * * *